United States Patent [19]

Salvino

[11] Patent Number: 4,753,434

[45] **Date of Patent: * Jun. 28, 1988**

[54] HAND HELD MUSCLE BUILDER

[76] Inventor: Lawrence P. Salvino, 23557 W. Milton Rd., Wauconda, Ill. 60084

[ * ] Notice: The portion of the term of this patent subsequent to Nov. 18, 2003 has been disclaimed.

[21] Appl. No.: 909,716

[22] Filed: Sep. 22, 1986

[51] Int. Cl.[4] ..... A63B 21/14

[52] U.S. Cl. ..... 272/68; 272/135; 272/DIG. 4

[58] Field of Search ..... 272/68, 69, 134, 135, 272/132, 140, 137, 141, 142, DIG. 4

[56] References Cited

U.S. PATENT DOCUMENTS

| | | | |
|---|---|---|---|
| 770,336 | 9/1904 | Terry | 272/68 |
| 2,837,334 | 6/1958 | Long | 272/68 |
| 2,926,911 | 3/1960 | Reichel | 272/68 |
| 3,129,939 | 4/1964 | Stock | 272/68 |
| 4,192,500 | 3/1980 | Crow et al. | 272/142 X |
| 4,279,415 | 7/1981 | Katz | 272/141 X |
| 4,280,696 | 7/1981 | Ramon | 272/140 |
| 4,433,364 | 2/1984 | Noble | 272/68 X |
| 4,513,962 | 4/1985 | Robson et al. | 272/142 X |
| 4,623,141 | 11/1986 | Salvino | 272/68 |

FOREIGN PATENT DOCUMENTS

| | | | |
|---|---|---|---|
| 188748 | of 1921 | United Kingdom | 272/68 |

*Primary Examiner*—Richard J. Apley
*Assistant Examiner*—David Bender
*Attorney, Agent, or Firm*—McCaleb, Lucas & Brugman

[57] ABSTRACT

A conventional hand held, manually operable exercise device for strengthening the hand and arm muscles in which a pair of hand engageable handles are movable toward one another to tension an intervening coil spring. A resistor is attachable to the exercise device for selectively varying the resistance to closing movement of the handles.

6 Claims, 2 Drawing Sheets

HAND HELD MUSCLE BUILDER

BACKGROUND OF THE INVENTION

Hand held, spring loaded exercise devices in which a pair of spaced operating handles fastened to extending ends of an intervening coil spring are squeezed toward one another by the operator's hand are known in the art. From my prior application Ser. No. 728,349, filed Apr. 29, 1985, now U.S. Pat. No. 4,623,141, issued Nov. 18, 1986, it is also known to provide flexible tubular means in the open interior of the spring's coils for reinforcing and increasing the spring's resistance to being tensioned upon movement of the handles toward each other.

SUMMARY OF THE INVENTION

A hand and arm muscle exercise device having a stiff coiled spring formed with divergently extending end portions fitted with operating handle means whereby the operator squeezes the handles toward one another to tension the spring and exercise the related hand and arm muscles, and first resilient means, positioned within the open center of the coil spring, operable to selectively change the resistance to tensioning of the spring coils and additional resilient means selectively positioned between the operating handle means to operably provide additional selected resistance to closing movements of the handle means.

It is an important object of this invention to provide an improved hand exercise device.

It is another important object of this invention to provide an improved hand exercise device having manually engageable handle means operable to tension a coil spring and means for selectively increasing the force required to operate the device.

It is a further object of this invention to provide means attachable to a hand operated exercise device provided with a pair of separated handles attached to intervening spring means for exercising the operator's hand and arm muscles by closing the handles toward one another which comprises resiliently compressible means interferringly engageable with said handle means for increasing the force required to move the same toward one another.

Having described this invention, the above and further objects, features and advantages thereof will appear from the following description of a preferred embodiment of its features illustrated in the accompanying drawings and representing the best mode presently contemplated for enabling those of skill in the art to practice this invention.

IN THE DRAWINGS

DESCRIPTION OF THE PREFERRED EMBODIMENT

Figure 2:
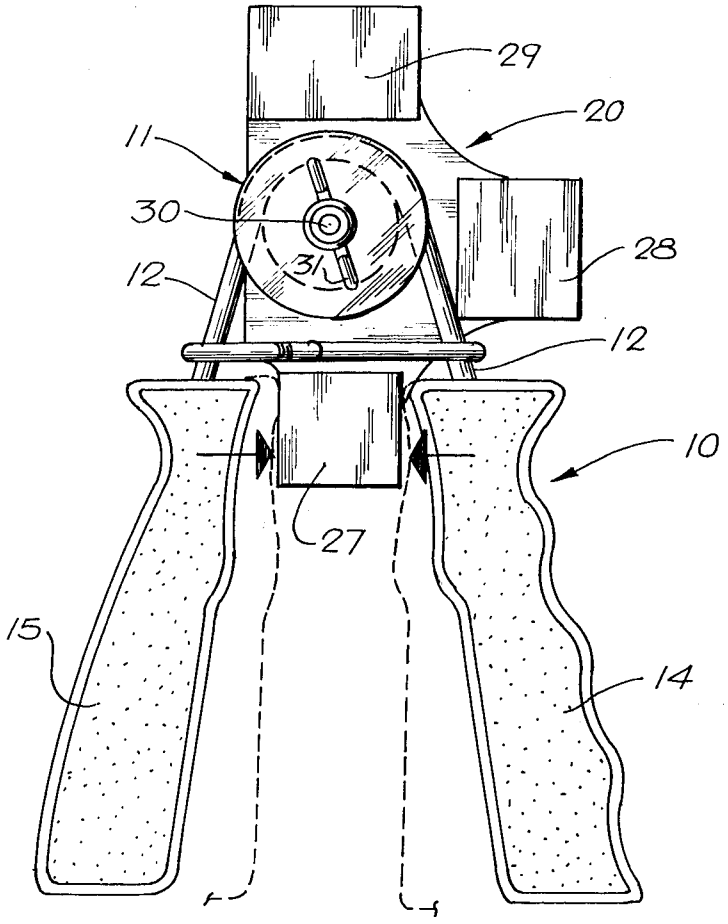
FIG. 2 is a front elevation thereof.
Figure 1:
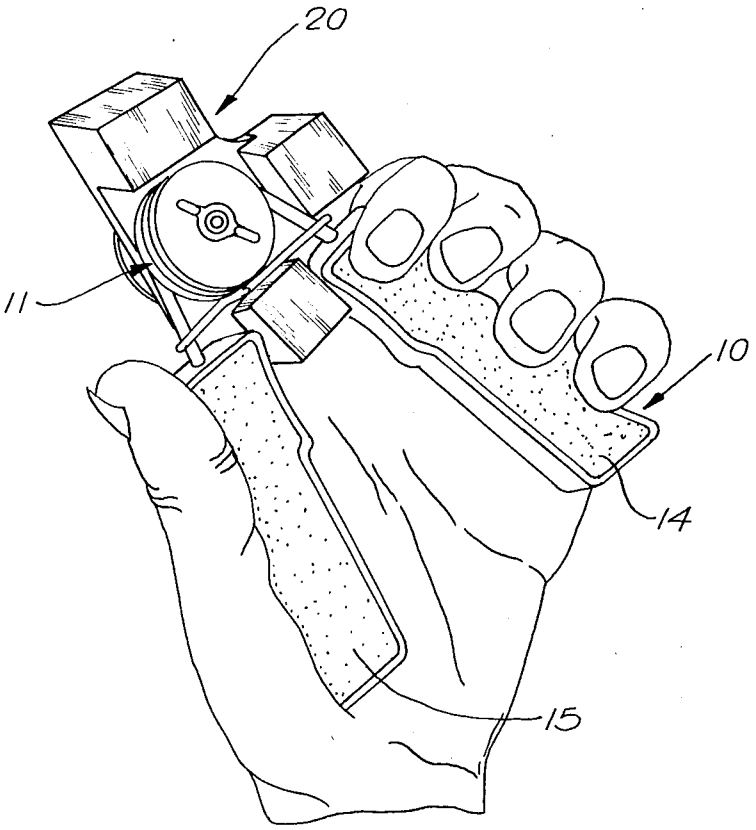
FIG. 1 is a perspective view of a hand exerciser embodying my present invention.
Figure 5:
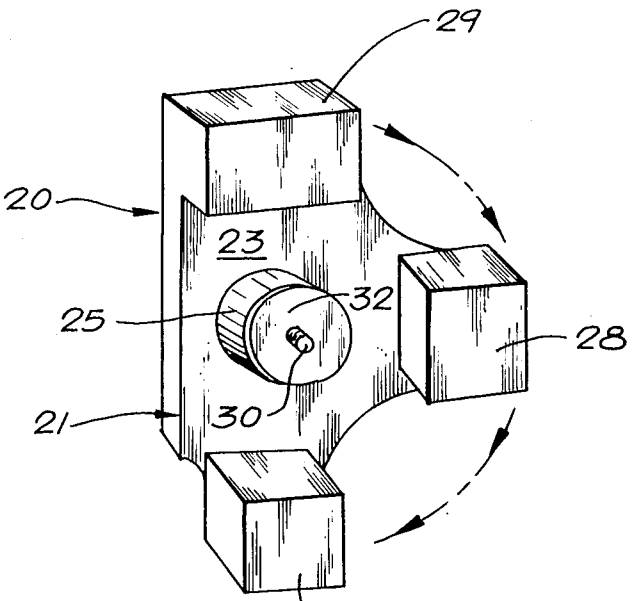
FIG. 5 is a perspective view of resistor means for use with a conventional hand exerciser according to this invention.
Figure 3:
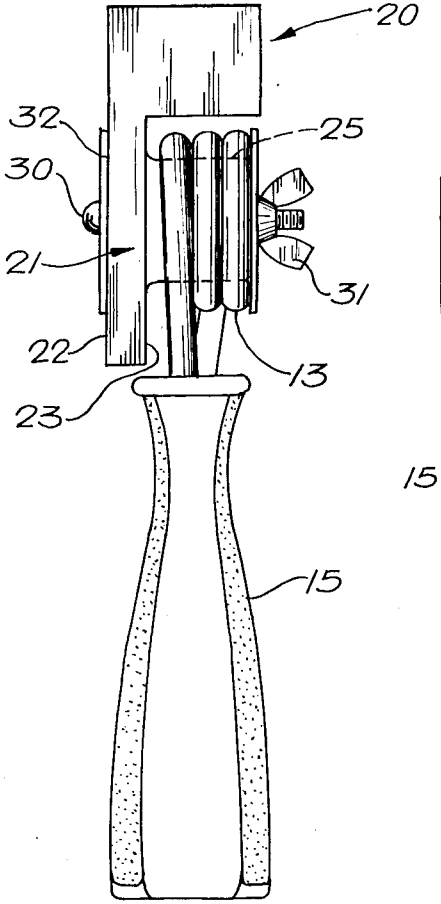
FIG. 3 is a side elevation thereof.

As illustrated in FIGS. 1, 2, and 3, a hand held and hand operated exercise device 10 of known construction has a heavy coiled spring 11 formed with divergently related end portions 12, 12 extending outwardly and downwardly from opposite ends of the spring's central coils 13. Such end portions are fitted with handle means 14, 15 engageable by the operator's hand. Squeezing the handle means toward one another tensions spring 11 and exercises the operator's hand and arm muscles. Such structure is old and known and readily available in the market place.

In order to increase the effective tension of the coil spring 11 and the effective resistance to closing movement of the handle means 14, 15 toward one another for the purpose of increasing the manual force required to operate the otherwise conventional exercise device 10 resistor means 20, illustrated in FIGS. 1–5 of my present invention is provided.

As there shown, means 20 comprises a relatively thin base portion 21, having parallel planar face walls 22, 23, which may be generally triangular in plan as illustrated, or of other suitable polygonal shape, such as square or circular in plan.

Projecting outwardly from face wall 23 and located generally equidistant from the imaginary corners of the triangular shaped base portion illustrated, is a hub member 25 which may be cylindrical, but preferably frusto-conical, having an axial opening 26 which extends through base portion 21 to communicate with face wall 22. The frusto-conical hub member 15 is adapted to fit different diameter springs 11.

Located at the three corners of the base portion and projecting outwardly of face wall 23 are three masses or block formations 27, 28 and 29 of general rectangular parallelopepid configuration. The three mass formations illustrated are of like length and thickness (measured from face 22), but are distinctly different in width. For example, in a typical application as illustrated, (see FIG. 5) the mass 27 is in the order of 1 inch long, 1 inch thick and $\frac{5}{8}$ inches wide; mass 28 is 1 inch long, 1 inch thick and $\frac{7}{8}$ inches wide and mass 29 is 1 inch long, 1 inch thick and $1\frac{1}{8}$ inches wide. These dimensions are not critical and may be varied to change the mass size depending on the results desired, but at least one such mass is required to practice this invention as will appear presently.

Preferably resistor means 20 is formed as a unitary molding made of flexible compressible material, such as rubber, plastic or rubber-like synthetic with the hub member 25 and spaced masses 27–29 integral with the base portion 21. The hardness of the selected material is an important factor since it materially affects compressibility of the masses. In the presently illustrated embodiment black rubber having a durometer hardness of 50 has proven operationally satisfactory for the resistor means. If desired, base portion 21 may be rigid metal or plastic and resilient hub 25 and the masses 27–29 formed separatly and attached to the base portion.

Figure 7:
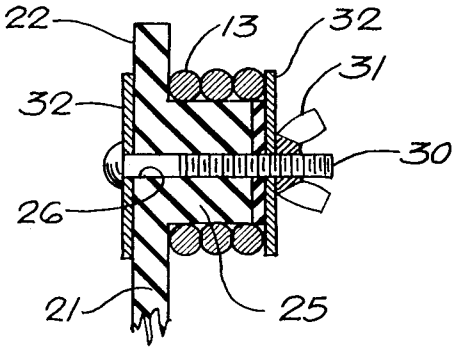
FIG. 7 is another cross-sectional view, similar to FIG. 6, showing the hub member in a compressed state.
Figure 4:
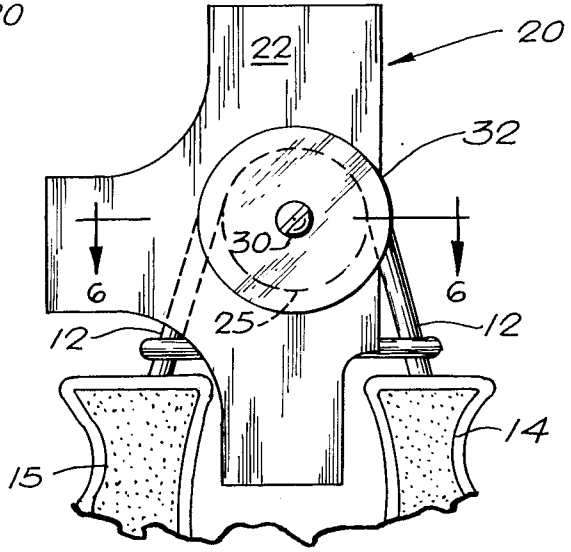
FIG. 4 is a partial rear elevation thereof.
Figure 6:
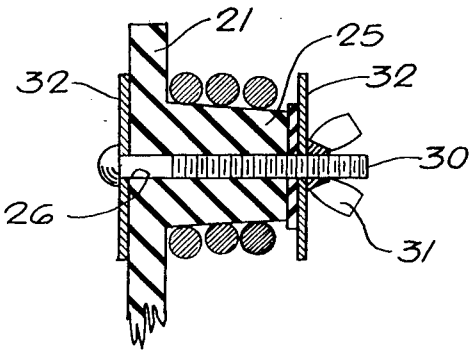
FIG. 6 is a partial cross-sectional view taken substantially along vantage line 6—6 of FIG. 4, showing a central hub member in an uncompressed state.

Resistor means 20 is mountable on the conventional hand exerciser by inserting the hub portion 25 thereof endwise into the open center of coil spring 11. A rod 30 is positioned in the axial opening 26 of the hub portion and is threaded at one end to received wing nut 31 and washers 32 outwardly of the outer end of the hub portion and face wall 22 as shown in FIGS. 3, 6, and 7.

Other forms of attachment means also may be employed for this purpose, as desired.

In operation, tightening the wing nuts 31 to advance along the threaded rod 30 causes the washers 32 to squeeze the tubular hub member axially and selectively expand the same radially against the surrounding coils of spring 11. This reinforces the spring to increase its resistance to torsional loading and radial contraction, making it more difficult to squeeze the handle means 14 and 15 together generally in accordance with the teachings of my prior application Ser. No. 728,349 now U.S. Pat. No. 4,623,141.

In addition to the described functioning of the hub member to increase the spring's resistance to torsional loading, the several mass formations 27–29, are used to increase the effective resistance to closing the handle means together. This is accomplished by loosening the rod and nut means sufficiently to rotatably index one of the mass formations or blocks between the separated handle means, after which the nut is again tightened to compress the hub member if and as desired. It will be appreciated that movement of the two handle means toward one another causes the same to interferringly engage and squeeze the intervening mass or block, compressing the same along its width axis in the illustrated case. By placing progressively wider blocks 27–29 between the handle means, progressively greater force is required to close the handle means. By changing the hardness and/or width dimensions of the masses 27–28 in particular and or by adding additional different sized masses spaced along the periphery of the resistor base, a variety of resistances are available. In the illustrated embodiment the masses are spaced at 90° intervals with one side of the base left open. By placing the open base area opposite the opening between the handle means, the operator can rely on the adjustable hub member to vary spring closing resistance and thereafter graduate to the stiffer resistances provided by the spaced masses as his muscles become stronger.

From the foregoing it is believed that those of skill in this art will recognize the novel advancement over the prior art provided by the present invention. Although a single embodiment has been shown and described herein, it is to be understood that changes, alterations and substitutions of equivalents may be made without departing from the scope of this invention as defined in the following appended claims.

I claim:

1. A hand operated exercise device for strengthening the operator's hand and arm muscles of the type having a heavy, multi-coiled torsion spring with divergently related end portions provided with separated handle means operable to move arcuately toward and away from one another about the central axis of the spring coils, in combination with, resistor means comprising first axially compressible resilient means operable to increase the resistance of said spring by radially resisting contraction of the coils thereof, and second resilient means located between said handle means to operably oppose movement thereof toward one another.

2. the exercise device in claim 1 wherein said first resilient means comprises a frusto-conical elastomeric member disposed coaxially within the open center of the spring coils, and means for axially compressing said member to radially reinforce said coils against torsional loading effected by movement of said handle means toward one another; and said second resilient means comprises at least one mass of resiliently compressible elastomeric material located between said handle means for interfering engagement therewith.

3. The exercise device of claim 1 wherein said first and second resilient means are secured to a common rotatably mounted base supported on said spring; said second resilient means being disposed radially outwardly of said first resilient means and positionable between the convergent ends of said handle means in response to selected rotational movement of said base.

4. The device of claim 3 wherein said first and second resilient means and said base are integrally formed as a unitary elastomeric member supported for rotational movement about the central axis of said spring coils.

5. The device of claim 1 wherein said second resilient means comprises a plurality of different sized, separated, elastomeric masses supported outwardly of said spring and mounted to be selectively positionable one-by-one between said handle means to provide selectively varied resistance to movement of said handle means toward one another.

6. In a hand held exerciser having a heavy coiled torsion spring formed with divergently extending end portions provided with manually engageable handles so that closing movement of the handles toward each other serves to torsionally load the coils of said spring to exercise a user's hand and arm muscles; improved resistor means for increasing the force required to move said handles toward one another, comprising: resiliently compressible elastomeric means moveably supported on the exerciser and selectively positionable between the convergent ends of said handles to resist closing movement thereof, said elastomeric means comprising, a plurality of different size elastomeric masses, each presenting a different resistance to said closing movement of said handles, base means supporting said masses in spaced relation, and means moveably mounting said base means on said exerciser whereby to selectively position each of said masses one-by-one between said handles.

* * * * *